US006311528B1

(12) United States Patent
Goodman et al.

(10) Patent No.: US 6,311,528 B1
(45) Date of Patent: Nov. 6, 2001

(54) TWISTED FUR PROCESS

(75) Inventors: David Goodman, 470 W. 24th St., New York, NY (US) 10011; Costas Aplezis, Queens, NY (US)

(73) Assignees: David Goodman; Mark Goodman, both of New York, NY (US)

( * ) Notice: Subject to any disclaimer, the term of this patent is extended or adjusted under 35 U.S.C. 154(b) by 0 days.

(21) Appl. No.: 09/559,847

(22) Filed: Apr. 27, 2000

(51) Int. Cl.[7] ..... C14B 1/00; A41D 5/00
(52) U.S. Cl. ..... 69/22; 69/23; 2/65; 2/66
(58) Field of Search ..... 69/22, 23; 2/65, 2/66

(56) References Cited

U.S. PATENT DOCUMENTS 4,741,055 * 5/1988 Lee ..... 2/65
5,172,428 * 12/1992 Leinoff ..... 2/65
5,581,814 * 12/1996 Ettinger ..... 2/65

* cited by examiner

*Primary Examiner*—Bibhu Mohanty
(74) *Attorney, Agent, or Firm*—Patrick J. Walsh

(57) ABSTRACT

A process for producing fur garments, trimmings, and other miscellaneous accessories involving one or more strips of fur to produce a spiraled, feathery textured effect. The invention includes garments, trimmings and accessories made by the inventive process.

7 Claims, 1 Drawing Sheet

TWISTED FUR PROCESS

BACKGROUND OF THE INVENTION

The present invention relates to a process for producing fur garments, trimmings, and other miscellaneous accessories involving one or more strips of fur to produce a spiraled, feathery textured effect. The invention also relates to garments, trimmings and accessories made by the inventive process.

SUMMARY OF THE INVENTION

In preferred embodiment, the invention is a method or process for producing fur trimmings, boas, and other accessories beginning with furs in one or more long thin strips. In a preferred method, two or more of the strips are stitched together lengthwise and the leather side of the stitched strips is wetted with water or other liquid. One end of the wetted strips is secured to a fur blocking board and the other end of the strips is secured to twisting means such as a hand held rotary drill. The stitched and wetted strips are then twisted around each other until the desired look is achieved. The other end of the strips is removed from the twist means and secured to the blocking board in order to hold the twisted fur strips taut during the drying period. The strips remain on the board until dry. When dry, the strips are removed from the board and will retain their intertwined shape.

The twisted fur provides the latest in fur fashion accessories as a scarf, a fling, a boa, or a fur trim for evening or outerware. The fur trim is the perfect way for a fashion aficionado to add flair and sophistication to her wardrobe without spending a fortune. By simply wrapping twisted fur around the neckline of a coat, suit or dress, the outfit becomes instantly fur trimmed.

Twisted fur is available in a myriad of fashion colors including pastels, bright neons, earth tones, as well as naturals so as to be coordinated with any wardrobe.

OBJECTS OF THE INVENTION

An object of the invention is to provide a method for making fur fashion accessories.

Another object of the invention is to provide garments, trimmings, boas, and other accessories using twisted fur strips.

Other and further objects of the invention will become apparent with an understanding of the following detailed description of the invention or upon employment of the invention in practice.

A preferred embodiment of the invention has been chosen for detailed description to enable those having ordinary skill in the art to which the invention appertains to readily understand how to construct and use the invention and is shown in the accompanying drawing in which:

FIGS. 1*a–e* are an illustration of steps for making twisted fur according to a preferred embodiment of the invention.

DETAILED DESCRIPTION OF THE PREFERRED EMBODIMENT

Figure 1A:
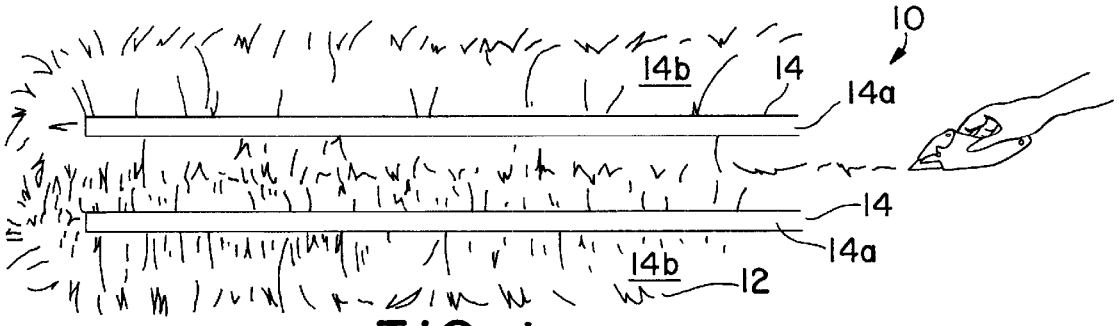
Figure 1B:
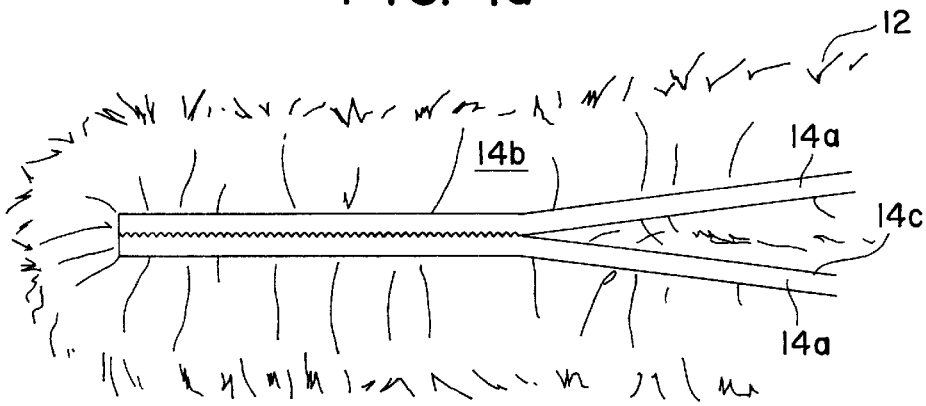
Figure 1C:
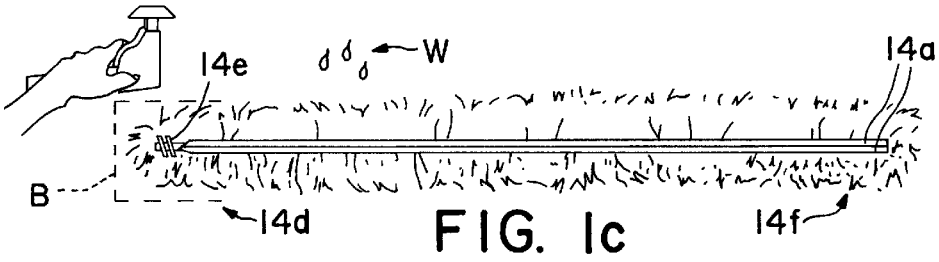
Figure 1D:
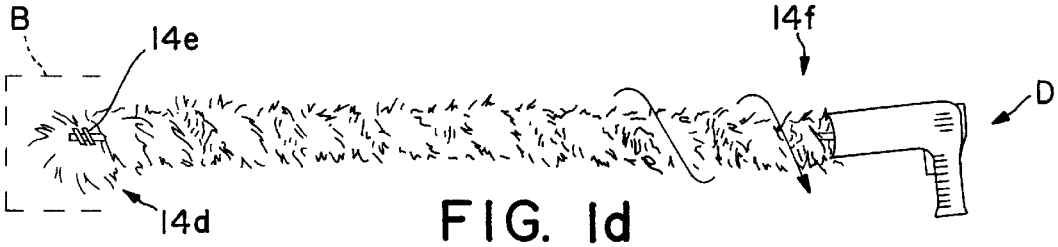
Figure 1E:
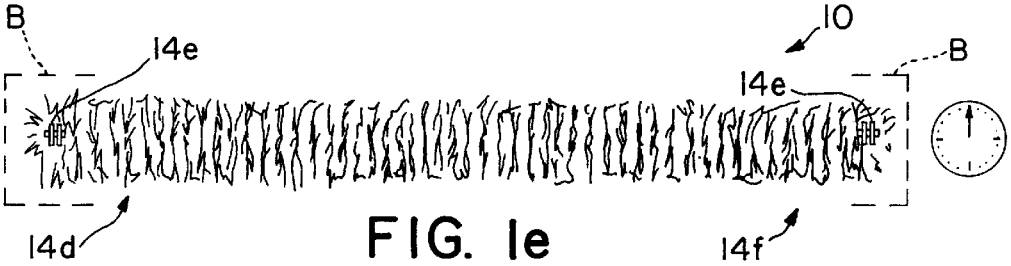

Referring to FIGS. 1*a–e* of the drawing, the invention in preferred embodiment, comprises a method for producing fur twists 10. To begin, furs 12 are sliced into long thin strips 14 with each strip having leather 14*a* and fur portions 14*b* (FIG. 1*a*). Two or more of the strips are stitched together lengthwise (FIG. 1*b*) along one edge 14*c* using a fur sewing machine (not shown) Next, the leather side 14*a* of each of the stitched strips is wetted with water W or other liquid (FIG. 1*c*). One end 14*d* of the wetted strips is secured against rotation, by staples 14*e* for example, to a fur blocking board B and the other end 14*f* of the strips is secured to twisting means such as a hand held rotary drill D (FIG. 1*d*). The stitched and wetted strips are then twisted lengthwise around each other until the desired look is achieved (FIG. 1*d*) . The other end 14*f* of the strips is removed from the twist means and secured to the blocking board B in order to hold the twisted fur strips taut during the drying period (FIG. 1*e*) The strips remain on the board until dry. When dry, the strips are removed from the board and will retain their intertwined shape.

If desired, a single strip of fur with leather back can be used in making twisted fur according to the invention. When a single strip is used, the slicing and stitching steps are omitted while including each of the other steps (FIGS. 1*c*–1*e*) in the method.

When complete, a piece of twisted fur may be used as a fashion accessory. In addition, a plurality of twisted fur pieces can be assembled into garments G such as jackets, stoles, scarves and so forth.

Various changes may be made to the structure embodying the principles of the invention. The foregoing embodiments are set forth in an illustrative and not in a limiting sense. The scope of the invention is defined by the claims appended hereto.

We claim:

1. A method for producing fur trimmings comprising the steps of slicing fur into a plurality long thin strips having a fur side and a leather side, stitching the strips together lengthwise, wetting the leather side of the stitched strips, securing one end of the wetted strips against rotation, securing the other end of the strips to twisting means, twisting the stitched and wetted strips around each other, removing the other end of the strips from the twist means, and securing the other end in order to hold the twisted fur strips taut, drying the strips, and removing the dried strips from the board.

2. A method for producing fur trimmings comprising the steps of forming a long thin strip having a fur side and a leather side, wetting the leather side of the strip with water or other liquid, securing one end of the wetted strip against rotation, securing the other end of the strip to twisting means, twisting the strip about itself, removing the other end of the strip from the twist means, and securing the other end in order to hold the twisted fur strip taut, and drying the strip.

3. A method for producing a garment assembled using twisted fur pieces comprising the steps of slicing fur into a plurality long thin strips having a fur side and a leather side, stitching the strips together lengthwise, wetting the leather side of the stitched strips, securing one end of the wetted strips to a fur blocking board, securing the other end of the strips to twisting means, twisting the stitched and wetted strips around each other, removing the other end of the strips from the twist means, and securing the other end to the blocking board in order to hold the twisted fur strips taut, drying the strips, removing the dried strips from the board, and assembling the dried strips into a garment.

4. A garment fabricated by the method comprising the steps of slicing fur into a plurality long thin strips having a fur side and a leather side, stitching the strips together lengthwise, wetting the leather side of the stitched strips, securing one end of the wetted strips to a fur blocking board, securing the other end of the strips to twisting means, twisting the stitched and wetted strips around each other, removing the other end of the strips from the twist means, and securing the other end to the blocking board in order to hold the twisted fur strips taut, drying the strips, removing the dried strips from the board, and stitching the dried twisted fur strips into a garment.

5. A garment fabricated by the method comprising the steps of forming fur into a long thin strip having a fur side and a leather side, wetting the leather side of the strip, securing one end of the wetted strip against rotation, securing the other end of the strip to twisting means, twisting the strip, removing the other end of the strip from the twist means, and securing the other end to hold the twisted fur strip taut, drying the strip, removing the dried strip from secured position, and stitching a plurality of dried twisted fur strip so formed into a garment.

6. A fur trimming produced by the method of slicing fur into a plurality long thin strips having a fur side and a leather side, stitching the strips together lengthwise, wetting the leather side of the stitched strips, securing one end of the wetted strips against rotation, securing the other end of the strips to twisting means, twisting the stitched and wetted strips around each other, removing the other end of the strips from the twist means, and securing the other end in order to hold the twisted fur strips taut, and drying the strips.

7. A fur trimming produced by the method of forming fur into a long thin strip having a fur side and a leather side, wetting the leather side of the strip, securing one end of the wetted strip against rotation, securing the other end of the strips to twisting means, twisting the stitched and wetted strips around each other, removing the other end of the strips from the twist means, and securing the other end in order to hold the twisted fur strips taut, and drying the strips.

* * * * *